US009624595B2

(12) United States Patent
Fu et al.

(10) Patent No.: US 9,624,595 B2
(45) Date of Patent: Apr. 18, 2017

(54) ELECTROPLATING APPARATUS WITH IMPROVED THROUGHPUT

(71) Applicant: Silevo, Inc., Fremont, CA (US)

(72) Inventors: Jianming Fu, Palo Alto, CA (US); Wen Zhong Kong, Newark, CA (US)

(73) Assignee: SolarCity Corporation, San Mateo, CA (US)

( * ) Notice: Subject to any disclaimer, the term of this patent is extended or adjusted under 35 U.S.C. 154(b) by 8 days.

(21) Appl. No.: 14/286,841

(22) Filed: May 23, 2014

(65) Prior Publication Data

US 2014/0346035 A1 Nov. 27, 2014

Related U.S. Application Data

(60) Provisional application No. 61/827,460, filed on May 24, 2013.

(51) Int. Cl.
*C25D 17/00* (2006.01)
*C25D 17/06* (2006.01)
(Continued)

(52) U.S. Cl.
CPC ..... *C25D 17/001* (2013.01); *C25D 17/007* (2013.01); *C25D 17/06* (2013.01); *C25D 17/08* (2013.01); *C25D 17/10* (2013.01)

(58) Field of Classification Search
CPC ..... C25D 17/06; C25D 17/08; C25D 17/001; C25D 7/12; H01L 21/67
(Continued)

(56) References Cited

U.S. PATENT DOCUMENTS 819,360 A 3/1902 Mayer
2,626,907 A 1/1953 De Groote
(Continued)

FOREIGN PATENT DOCUMENTS

CN 100580957 C 1/2010
CN 104409402 3/2015
(Continued)

OTHER PUBLICATIONS

Beaucarne G et al: 'Epitaxial thin-film Si solar cells' Thin Solid Films, Elsevier-Sequoia S.A. Lausanne, CH LNKD—DOI:10.1016/J.TSF.2005.12.003, vol. 511-512, Jul. 26, 2006 (Jul. 26, 2006), pp. 533-542, XP025007243 ISSN: 0040-6090 [retrieved on Jul. 26, 2006].

(Continued)

*Primary Examiner* — Luan Van
*Assistant Examiner* — Alexander W Keeling
(74) *Attorney, Agent, or Firm* — Shun Yao; Park, Vaughan, Fleming & Dowler LLP

(57) ABSTRACT

One embodiment provides an electroplating apparatus, which includes a tank filled with an electrolyte solution, a number of anodes situated around edges of the tank, a cathode situated above the tank, and a plurality of wafer-holding jigs attached to the cathode. A respective wafer-holding jig includes a common connector electrically coupled to the cathode and a pair of wafer-mounting frames electrically coupled to the common connector. Each wafer-mounting frame includes a plurality of openings, and a respective opening provides a mounting space for a to-be-plated solar cell, thereby facilitating simultaneous plating of front and back surfaces of the plurality of the solar cells.

15 Claims, 6 Drawing Sheets

(51) Int. Cl.
*C25D 17/08* (2006.01)
*C25D 17/10* (2006.01)

(58) Field of Classification Search
USPC ..... 204/297.01, 297.06, 297.1, 297.12, 204/297.14; 205/118, 122
See application file for complete search history.

(56) References Cited

U.S. PATENT DOCUMENTS 2,938,938 A 5/1960 Dickson
3,094,439 A 6/1963 Mann
3,116,171 A 12/1963 Nielson
3,459,597 A 8/1969 Baron
3,961,997 A 6/1976 Chu
3,969,163 A 7/1976 Wakefield
4,015,280 A 3/1977 Matsushita
4,082,568 A 4/1978 Lindmayer
4,124,410 A 11/1978 Kotval
4,124,455 A 11/1978 Lindmayer
4,193,975 A 3/1980 Kotval
4,200,621 A 4/1980 Liaw
4,213,798 A 7/1980 Williams
4,251,285 A 2/1981 Yoldas
4,284,490 A 8/1981 Weber
4,315,096 A 2/1982 Tyan
4,336,648 A 6/1982 Pschunder
4,342,044 A 7/1982 Ovshinsky
4,431,858 A 2/1984 Gonzalez
4,514,579 A 4/1985 Hanak
4,540,843 A 9/1985 Gochermann
4,567,642 A 2/1986 Dilts
4,571,448 A 2/1986 Barnett
4,577,051 A 3/1986 Hartman
4,586,988 A 5/1986 Nath
4,589,191 A 5/1986 Green
4,612,409 A 9/1986 Hamakawa
4,617,421 A 10/1986 Nath
4,633,033 A 12/1986 Nath
4,652,693 A 3/1987 Bar-On
4,667,060 A 5/1987 Spitzer
4,670,096 A 6/1987 Schwirtlich
4,694,115 A 9/1987 Lillington
4,771,017 A 9/1988 Tobin
4,784,702 A 11/1988 Henri
4,820,396 A * 4/1989 de Masi ..... C23C 18/163 118/500
4,877,460 A 10/1989 Flodl
4,933,061 A * 6/1990 Kulkarni ..... C25D 17/02 204/224 R
5,053,355 A 10/1991 von Campe
5,075,763 A 12/1991 Spitzer
5,084,107 A 1/1992 Deguchi
5,118,361 A 6/1992 Fraas
5,131,933 A 7/1992 Floedl
5,178,685 A 1/1993 Borenstein
5,181,968 A 1/1993 Nath
5,213,628 A 5/1993 Noguchi
5,217,539 A 6/1993 Fraas
5,279,682 A 1/1994 Wald
5,286,306 A 2/1994 Menezes
5,364,518 A 11/1994 Hartig
5,401,331 A 3/1995 Ciszek
5,455,430 A 10/1995 Noguchi
5,461,002 A 10/1995 Safir
5,563,092 A 10/1996 Ohmi
5,576,241 A 11/1996 Sakai
5,627,081 A 5/1997 Tsuo
5,676,766 A 10/1997 Probst
5,681,402 A 10/1997 Ichinose
5,698,451 A 12/1997 Hanoka
5,705,828 A 1/1998 Noguchi
5,726,065 A 3/1998 Szlufcik
5,808,315 A 9/1998 Murakami
5,814,195 A 9/1998 Lehan
5,903,382 A 5/1999 Tench
5,935,345 A 8/1999 Kuznicki
6,034,322 A 3/2000 Pollard
6,091,019 A 7/2000 Sakata
6,140,570 A 10/2000 Kariya
6,232,545 B1 5/2001 Samaras
6,303,853 B1 10/2001 Fraas
6,333,457 B1 12/2001 Mulligan
6,410,843 B1 6/2002 Kishi
6,441,297 B1 8/2002 Keller
6,488,824 B1 12/2002 Hollars
6,538,193 B1 3/2003 Fraas
6,552,414 B1 4/2003 Horzel
6,586,270 B2 7/2003 Tsuzuki
6,620,645 B2 9/2003 Chandra
6,672,018 B2 1/2004 Shingleton
6,683,360 B1 1/2004 Dierickx
6,736,948 B2 5/2004 Barrett
6,803,513 B2 10/2004 Beernink
6,841,051 B2 1/2005 Crowley
7,030,413 B2 4/2006 Nakamura
7,164,150 B2 1/2007 Terakawa
7,328,534 B2 2/2008 Dinwoodie
7,388,146 B2 6/2008 Fraas
7,399,385 B2 7/2008 German
7,534,632 B2 5/2009 Hu
7,635,810 B2 12/2009 Luch
7,737,357 B2 6/2010 Cousins
7,749,883 B2 7/2010 Meeus
7,769,887 B1 8/2010 Bhattacharyya
7,772,484 B2 8/2010 Li
7,777,128 B2 8/2010 Montello
7,825,329 B2 11/2010 Basol
7,829,781 B2 11/2010 Montello
7,829,785 B2 11/2010 Basol
7,872,192 B1 1/2011 Fraas
7,905,995 B2 3/2011 German
7,977,220 B2 7/2011 Sanjurjo
8,070,925 B2 12/2011 Hoffman
8,152,536 B2 4/2012 Scherer
8,168,880 B2 5/2012 Jacobs
8,182,662 B2 5/2012 Crowley
8,196,360 B2 6/2012 Metten
8,209,920 B2 7/2012 Krause
8,222,513 B2 7/2012 Luch
8,222,516 B2 7/2012 Cousins
8,343,795 B2 1/2013 Luo
8,586,857 B2 11/2013 Everson
8,671,630 B2 3/2014 Lena
2001/0008143 A1 7/2001 Sasaoka
2002/0072207 A1 6/2002 Andoh
2002/0086456 A1 7/2002 Cunningham
2002/0176404 A1 11/2002 Girard
2002/0189939 A1 12/2002 German
2003/0000571 A1 1/2003 Wakuda
2003/0034062 A1 2/2003 Stern
2003/0042516 A1 3/2003 Forbes
2003/0070705 A1 4/2003 Hayden
2003/0097447 A1 5/2003 Johnston
2003/0116185 A1 6/2003 Oswald
2003/0121228 A1 7/2003 Stoehr
2003/0168578 A1 9/2003 Taguchi
2003/0183270 A1 10/2003 Falk
2003/0201007 A1 10/2003 Fraas
2004/0065363 A1 4/2004 Fetzer
2004/0103937 A1 6/2004 Bilyalov
2004/0112426 A1 6/2004 Hagino
2004/0123897 A1 7/2004 Ojima
2004/0135979 A1 7/2004 Hazelton
2004/0152326 A1 8/2004 Inomata
2004/0185683 A1 9/2004 Nakamura
2004/0200520 A1 10/2004 Mulligan
2005/0012095 A1 1/2005 Niira
2005/0022861 A1 2/2005 Rose
2005/0061665 A1* 3/2005 Pavani ..... C25D 17/08 204/297.06
2005/0064247 A1 3/2005 Sane
2005/0074954 A1 4/2005 Yamanaka
2005/0109388 A1 5/2005 Murakami

(56) References Cited

U.S. PATENT DOCUMENTS

2005/0133084 A1 6/2005 Joge
2005/0178662 A1 8/2005 Wurczinger
2005/0189015 A1 9/2005 Rohatgi
2005/0199279 A1 9/2005 Yoshimine
2005/0252544 A1 11/2005 Rohatgi
2005/0257823 A1 11/2005 Zwanenburg
2006/0012000 A1 1/2006 Estes
2006/0060238 A1 3/2006 Hacke
2006/0060791 A1 3/2006 Hazelton
2006/0130891 A1 6/2006 Carlson
2006/0154389 A1 7/2006 Doan
2006/0213548 A1 9/2006 Bachrach
2006/0231803 A1 10/2006 Wang
2006/0255340 A1 11/2006 Manivannan
2006/0283496 A1 12/2006 Okamoto
2006/0283499 A1 12/2006 Terakawa
2007/0023081 A1 2/2007 Johnson
2007/0023082 A1 2/2007 Manivannan
2007/0108437 A1 5/2007 Tavkhelidze
2007/0110975 A1 5/2007 Schneweis
2007/0132034 A1 6/2007 Curello
2007/0137699 A1 6/2007 Manivannan
2007/0148336 A1 6/2007 Bachrach
2007/0186968 A1 8/2007 Nakauchi
2007/0186970 A1 8/2007 Takahashi
2007/0202029 A1 8/2007 Burns
2007/0235829 A1 10/2007 Levine
2007/0256728 A1 11/2007 Cousins
2007/0274504 A1 11/2007 Maes
2007/0283996 A1 12/2007 Hachtmann
2007/0283997 A1 12/2007 Hachtmann
2008/0000522 A1 1/2008 Johnson
2008/0041437 A1 2/2008 Yamaguchi
2008/0047602 A1 2/2008 Krasnov
2008/0047604 A1 2/2008 Korevaar
2008/0053519 A1 3/2008 Pearce
2008/0061293 A1 3/2008 Ribeyron
2008/0092947 A1 4/2008 Lopatin
2008/0121272 A1 5/2008 Besser
2008/0121276 A1 5/2008 Lopatin
2008/0121932 A1 5/2008 Ranade
2008/0128013 A1 6/2008 Lopatin
2008/0149161 A1 6/2008 Nishida
2008/0156370 A1 7/2008 Abdallah
2008/0173350 A1 7/2008 Choi
2008/0196757 A1 8/2008 Yoshimine
2008/0202577 A1 8/2008 Hieslmair
2008/0202582 A1 8/2008 Noda
2008/0216891 A1 9/2008 Harkness
2008/0230122 A1 9/2008 Terakawa
2008/0251117 A1 10/2008 Schubert
2008/0264477 A1 10/2008 Moslehi
2008/0276983 A1 11/2008 Drake
2008/0283115 A1 11/2008 Fukawa
2008/0302030 A1 12/2008 Stancel
2008/0303503 A1 12/2008 Wolfs
2008/0308145 A1 12/2008 Krasnov
2009/0007965 A1 1/2009 Rohatgi
2009/0056805 A1 3/2009 Barnett
2009/0078318 A1 3/2009 Meyers
2009/0084439 A1 4/2009 Lu
2009/0101872 A1 4/2009 Young
2009/0139512 A1 6/2009 Lima
2009/0151783 A1 6/2009 Lu
2009/0155028 A1 6/2009 Boguslavskiy
2009/0160259 A1 6/2009 Ravindranath
2009/0188561 A1 7/2009 Aiken
2009/0221111 A1 9/2009 Frolov
2009/0229854 A1 9/2009 Fredenberg
2009/0239331 A1 9/2009 Xu
2009/0250108 A1 10/2009 Zhou
2009/0255574 A1 10/2009 Yu
2009/0283138 A1 11/2009 Lin
2009/0283145 A1 11/2009 Kim
2009/0293948 A1 12/2009 Tucci
2009/0317934 A1 12/2009 Scherff
2009/0320897 A1 12/2009 Shimomura
2010/0006145 A1 1/2010 Lee
2010/0015756 A1 1/2010 Weidman
2010/0043863 A1 2/2010 Wudu
2010/0065111 A1 3/2010 Fu
2010/0068890 A1 3/2010 Stockum
2010/0087031 A1 4/2010 Veschetti
2010/0108134 A1 5/2010 Ravi
2010/0116325 A1 5/2010 Nikoonahad
2010/0124619 A1 5/2010 Xu
2010/0132774 A1 6/2010 Borden
2010/0132792 A1 6/2010 Kim
2010/0147364 A1 6/2010 Gonzalez
2010/0169478 A1 7/2010 Saha
2010/0175743 A1 7/2010 Gonzalez
2010/0186802 A1 7/2010 Borden
2010/0193014 A1 8/2010 Johnson
2010/0218799 A1 9/2010 Stefani
2010/0224230 A1 9/2010 Luch
2010/0240172 A1 9/2010 Rana
2010/0269904 A1 10/2010 Cousins
2010/0279492 A1 11/2010 Yang
2010/0300506 A1 12/2010 Heng
2010/0300507 A1 12/2010 Heng
2010/0313877 A1 12/2010 Bellman
2010/0326518 A1 12/2010 Juso
2011/0005920 A1 1/2011 Ivanov
2011/0073175 A1 3/2011 Hilali
2011/0088762 A1 4/2011 Singh
2011/0146781 A1 6/2011 Laudisio
2011/0156188 A1 6/2011 Tu
2011/0168250 A1 7/2011 Lin
2011/0220182 A1 9/2011 Lin
2011/0245957 A1 10/2011 Porthouse
2011/0259419 A1 10/2011 Hagemann
2011/0272012 A1 11/2011 Heng
2011/0277688 A1 11/2011 Trujillo
2011/0277825 A1 11/2011 Fu et al.
2011/0284064 A1 11/2011 Engelhart
2011/0297224 A1 12/2011 Miyamoto
2011/0297227 A1 12/2011 Pysch
2012/0000502 A1 1/2012 Wiedeman
2012/0012174 A1 1/2012 Wu
2012/0028461 A1 2/2012 Ritchie
2012/0031480 A1 2/2012 Tisler
2012/0040487 A1 2/2012 Asthana
2012/0073975 A1* 3/2012 Ganti ..... C25D 17/08 205/80
2012/0085384 A1 4/2012 Beitel
2012/0125391 A1 5/2012 Pinarbasi
2012/0145233 A1 6/2012 Syn
2012/0152349 A1 6/2012 Cao
2012/0192932 A1 8/2012 Wu
2012/0240995 A1 9/2012 Coakley
2012/0248497 A1 10/2012 Zhou
2012/0279443 A1 11/2012 Kornmeyer
2012/0279548 A1 11/2012 Munch
2012/0285517 A1 11/2012 Souza
2012/0305060 A1 12/2012 Fu et al.
2012/0318319 A1 12/2012 Pinarbasi
2012/0318340 A1 12/2012 Heng
2012/0325282 A1 12/2012 Snow
2013/0000705 A1 1/2013 Shappir
2013/0014802 A1 1/2013 Zimmerman
2013/0096710 A1 4/2013 Pinarbasi
2013/0112239 A1 5/2013 Liptac
2013/0130430 A1 5/2013 Moslehi
2013/0139878 A1 6/2013 Bhatnagar
2013/0152996 A1 6/2013 DeGroot
2013/0206213 A1 8/2013 He
2013/0206221 A1 8/2013 Gannon
2013/0213469 A1 8/2013 Kramer
2013/0220401 A1 8/2013 Scheulov
2013/0228221 A1 9/2013 Moslehi
2013/0247955 A1 9/2013 Baba
2013/0269771 A1 10/2013 Cheun
2014/0000682 A1 1/2014 Zhao
2014/0066265 A1 3/2014 Oliver

(56) References Cited

U.S. PATENT DOCUMENTS

| | | | | |
|---|---|---|---|---|
| 2014/0124013 | A1 | 5/2014 | Morad | |
| 2014/0124014 | A1 | 5/2014 | Morad | |
| 2014/0154836 | A1* | 6/2014 | Kim | H01L 31/18 438/98 |
| 2014/0196768 | A1 | 7/2014 | Heng | |
| 2014/0242746 | A1 | 8/2014 | Albadri | |
| 2014/0318611 | A1 | 10/2014 | Moslehi | |
| 2014/0345674 | A1 | 11/2014 | Yang | |
| 2015/0020877 | A1 | 1/2015 | Moslehi | |
| 2015/0171230 | A1 | 6/2015 | Kapur | |
| 2015/0176148 | A1* | 6/2015 | Kim | C25D 17/001 204/297.1 |
| 2015/0349145 | A1 | 12/2015 | Morad | |
| 2015/0349153 | A1 | 12/2015 | Morad | |
| 2015/0349161 | A1 | 12/2015 | Morad | |
| 2015/0349162 | A1 | 12/2015 | Morad | |
| 2015/0349167 | A1 | 12/2015 | Morad | |
| 2015/0349168 | A1 | 12/2015 | Morad | |
| 2015/0349169 | A1 | 12/2015 | Morad | |
| 2015/0349170 | A1 | 12/2015 | Morad | |
| 2015/0349171 | A1 | 12/2015 | Morad | |
| 2015/0349172 | A1 | 12/2015 | Morad | |
| 2015/0349173 | A1 | 12/2015 | Morad | |
| 2015/0349174 | A1 | 12/2015 | Morad | |
| 2015/0349175 | A1 | 12/2015 | Morad | |
| 2015/0349176 | A1 | 12/2015 | Morad | |
| 2015/0349190 | A1 | 12/2015 | Morad | |
| 2015/0349193 | A1 | 12/2015 | Morad | |
| 2015/0349701 | A1 | 12/2015 | Morad | |
| 2015/0349702 | A1 | 12/2015 | Morad | |
| 2015/0349703 | A1 | 12/2015 | Morad | |
| 2016/0190354 | A1 | 6/2016 | Agrawal | |

FOREIGN PATENT DOCUMENTS

| | | | | |
|---|---|---|---|---|
| DE | 4030713 | | 4/1992 | |
| DE | 202007002897 | | 8/2008 | |
| DE | 102012010151 | | 11/2013 | |
| EP | 1770791 | | 4/2007 | |
| EP | 1806684 | | 8/2007 | |
| EP | 2071635 | | 6/2009 | |
| EP | 2362430 | | 8/2011 | |
| EP | 2385561 | A2 | 11/2011 | |
| EP | 2479796 | A1 | 7/2012 | |
| EP | 2626907 | A1 | 8/2013 | |
| EP | 2479796 | | 7/2015 | |
| EP | 2626907 | | 8/2015 | |
| JP | H04245683 | A | 9/1992 | |
| JP | H07249788 | A | 9/1995 | |
| JP | 10004204 | | 1/1998 | |
| JP | H1131834 | | 2/1999 | |
| JP | 2002057357 | A | 2/2002 | |
| JP | 2005159312 | A | 6/2005 | |
| JP | 2009177225 | | 8/2009 | |
| KR | 20050122721 | A | 12/2005 | |
| KR | 20060003277 | A | 1/2006 | |
| KR | 20090011519 | A | 2/2009 | |
| KR | WO 2013109009 | A1 * | 7/2013 | H01L 31/18 |
| WO | 9117839 | | 11/1991 | |
| WO | 9120097 | A1 | 12/1991 | |
| WO | 03083953 | A1 | 10/2003 | |
| WO | 2006097189 | A1 | 9/2006 | |
| WO | 2008089657 | | 7/2008 | |
| WO | 2009150654 | | 12/2009 | |
| WO | 2009150654 | A2 | 12/2009 | |
| WO | 2010070015 | | 6/2010 | |
| WO | 2010075606 | | 7/2010 | |
| WO | 2010075606 | A1 | 7/2010 | |
| WO | 2010085949 | | 8/2010 | |
| WO | 2010104726 | A2 | 9/2010 | |
| WO | 2010123974 | A1 | 10/2010 | |
| WO | 2011005447 | | 1/2011 | |
| WO | 2011005447 | A2 | 1/2011 | |
| WO | 2011008881 | | 1/2011 | |
| WO | 2011008881 | A2 | 1/2011 | |
| WO | 2011053006 | | 5/2011 | |
| WO | 2011123646 | A2 | 10/2011 | |
| WO | 2013020590 | A1 | 2/2013 | |
| WO | 2014074826 | | 7/2014 | |
| WO | 2014110520 | | 7/2014 | |

OTHER PUBLICATIONS

Chabal, Yves J. et al., 'Silicon Surface and Interface Issues for Nanoelectronics,' The Electrochemical Society Interface, Spring 2005, pp. 31-33.

Collins English Dictionary (Convex. (2000). In Collins English Dictionary. http://search.credoreference.com/content/entry/hcengdict/convex/0 on Oct. 18, 2014).

Cui, 'Chapter 7 Dopant diffusion', publically available as early as Nov. 4, 2010 at <https://web.archive.org/web/20101104143332/http://ece.uwaterloo.ca/~bcui/content/NE/%20343/Chapter/%207%20Dopant%20 diffusion%20_%20l.pptx> and converted to PDF.

Davies, P.C.W., 'Quantum tunneling time,' Am. J. Phys. 73, Jan. 2005, pp. 23-27.

Dosaj V D et al: 'Single Crystal Silicon Ingot Pulled From Chemically-Upgraded Metallurgical-Grade Silicon' Conference Record of the IEEE Photovoltaic Specialists Conference, May 6, 1975 (May 6, 1975), pp. 275-279, XP001050345.

Green, Martin A. et al., 'High-Efficiency Silicon Solar Cells,' IEEE Transactions on Electron Devices, vol. ED-31, No. 5, May 1984, pp. 679-683.

Hamm, Gary, Wei, Lingyum, Jacques, Dave, Development of a Plated Nickel Seed Layer for Front Side Metallization of Silicon Solar Cells, EU PVSEC Proceedings, Presented Sep. 2009.

JCS Pires, J Otubo, AFB Braga, PR Mei; The purification of metallurgical grade silicon by electron beam melting, J of Mats Process Tech 169 (2005) 16-20.

Khattak, C. P. et al., "Refining Molten Metallurgical Grade Silicon for use as Feedstock for Photovoltaic Applications", 16th E.C. Photovoltaic Solar Energy Conference, May 1-5, 2000, pp. 1282-1283.

Merriam-Webster online dictionary—"mesh". (accessed Oct. 8, 2012).

Mueller, Thomas, et al. "Application of wide-band gap hydrogenated amorphous silicon oxide layers to heterojunction solar cells for high quality passivation." Photovoltaic Specialists Conference, 2008. PVSC'08. 33rd IEEE. IEEE, 2008.

Mueller, Thomas, et al. "High quality passivation for heteroj unction solar cells by hydrogenated amorphous silicon suboxide films." Applied Physics Letters 92.3 (2008): 033504-033504.

Munzer, K.A. "High Throughput Industrial In-Line Boron BSF Diffusion" Jun. 2005. 20th European Photovoltaic Solar Energy Conference, pp. 777-780.

National Weather Service Weather Forecast Office ("Why Do We have Seasons?" http://www.crh.noaa.gov/lmk/?n=seasons Accessed Oct. 18, 2014).

O'Mara, W.C.; Herring, R.B.; Hunt L.P. (1990). Handbook of Semiconductor Silicon Technology. William Andrew Publishing/Noyes. pp. 275-293.

Roedern, B. von, et al., 'Why is the Open-Circuit Voltage of Crystalline Si Solar Cells so Critically Dependent on Emitter- and Base-Doping?' Presented at the 9th Workshop on Crystalline Silicon Solar Cell Materials and Processes, Breckenridge, CO, Aug. 9-11, 1999.

Stangl et al., Amorphous/Crystalline Silicon heterojunction solar cells—a simulation study; 17th European Photovoltaic Conference, Munich, Oct. 2001.

Warabisako T et al: 'Efficient Solar Cells From Metallurgical-Grade Silicon' Japanese Journal of Applied Physics, Japan Society of Applied Physics, JP, vol. 19, No. Suppl. 19-01, Jan. 1, 1980 (Jan. 1, 1980), pp. 539-544, XP008036363 ISSN: 0021-4922.

WP Leroy et al., "In Search for the Limits of Rotating Cylindrical Magnetron Sputtering", Magnetron, ION Processing and ARC Technologies European Conference, Jun. 18, 2010, pp. 1-32.

(56) References Cited

OTHER PUBLICATIONS

Yao Wen-Jie et al: 'Interdisciplinary Physics and Related Areas of Science and Technology;The p recombination layer in tunnel junctions for micromorph tandem solar cells', Chinese Physics B, Chinese Physics B, Bristol GB, vol. 20, No. 7, Jul. 26, 2011 (Jul. 26, 2011), p. 78402, XP020207379, ISSN: 1674-1056, DOI: 10.1088/1674-1056/20/7/078402.
Parthavi, "Doping by Diffusion and Implantation", <http://www.leb.eei.uni-erlangen.de/winterakademie/2010/report/course03/pdf/0306.pdf>.
Weiss, "Development of different copper seed layers with respect to the copper electroplating process," Microelectronic Engineering 50 (2000) 443-440, Mar. 15, 2000.
Tomasi, "Back-contacted Silicon Heterojunction Solar Cells With Efficiency>21%" 2014 IEEE.
Hornbachner et al., "Cambered Photovoltaic Module and Method for its Manufacture" Jun. 17, 2009.
Machine translation of JP 10004204 A, Shindou et al.

* cited by examiner

ELECTROPLATING APPARATUS WITH IMPROVED THROUGHPUT

RELATED APPLICATION

This application claims the benefit of U.S. Provisional Application No. 61/827,460, entitled "ELECTROPLATING APPARATUS FOR IMPROVING THROUGHPUT," by inventors Jianming Fu and Wen Zhong Kong, filed 24 May 2013.

BACKGROUND

Field

This disclosure is generally related to an electroplating apparatus used for fabrication of solar modules. More specifically, this disclosure is related to an electroplating apparatus that has an improved throughput.

Related Art

Conventional solar cells often rely on Ag grid on the light-facing side to collect light generated current. To form the Ag grid, conventional methods involve printing Ag paste (which often includes Ag particle, organic binder, and glass frit) onto the wafers and then firing the Ag paste at a temperature between 700° C. and 800° C. The high-temperature firing of the Ag paste ensures good contact between Ag and Si, and lowers the resistivity of the Ag lines. The resistivity of the fired Ag paste is typically between $5\times10^{-6}$ and $8\times10^{-6}$ ohm-cm, which is much higher than the resistivity of bulk silver.

In addition to the high series resistance, the electrode grid obtained by screen-printing Ag paste also has other disadvantages, including higher material cost, wider line width, and limited line height. As the price of silver rises, the material cost of the silver electrode has exceeded half of the processing cost for manufacturing solar cells. With the state-of-the-art printing technology, the Ag lines typically have a line width between 100 and 120 microns, and it is difficult to reduce the line width further. Although inkjet printing can result in narrower lines, inkjet printing suffers other problems, such as low productivity. The height of the Ag lines is also limited by the printing method. One print can produce Ag lines with a height that is less than 25 microns. Although multiple printing can produce lines with increased height, it also increases line width, which is undesirable for high-efficiency solar cells. Similarly, electroplating of Ag or Cu onto the printed Ag lines can increase line height at the expense of increased line width. In addition, the resistance of such Ag lines is still too high to meet the requirement of high-efficiency solar cells.

Another solution is to electroplate a metal grid, which can include one or more metal layers, directly on the Si emitter or on a TCO layer above the emitter. The electroplated metal grid tend to have lower resistance (the resistivity of plated Cu is typically between $2\times10^{-6}$ and $3\times10^{-6}$ ohm-cm) than the printed metal grid. In large-scale solar cell fabrications, throughput can be a key to reduce to the overall fabrication cost.

SUMMARY

One embodiment provides an electroplating apparatus, which includes a tank filled with an electrolyte solution, a number of anodes situated around edges of the tank, a cathode situated above the tank, and a plurality of wafer-holding jigs attached to the cathode. A respective wafer-holding jig includes a common connector electrically coupled to the cathode and a pair of wafer-mounting frames electrically coupled to the common connector. Each wafer-mounting frame includes a plurality of openings, and a respective opening provides a mounting space for a to-be-plated solar cell, thereby facilitating simultaneous plating of front and back surfaces of the plurality of the solar cells.

In a variation on the embodiment, the cathode is configured to move from one end of the tank to the other end of the tank, thereby facilitating continuous operation of the electroplating apparatus.

In a variation on the embodiment, the wafer-mounting frame is made of one or more materials selected from the following group: stainless steel, Ti, and Cu.

In a variation on the embodiment, the opening is slightly larger than the to-be-plated solar cell.

In a variation on the embodiment, the wafer-mounting frame further comprises a plurality of spring-loaded pins that hold the to-be-plated solar cell inside the opening in a way such that a surface of the to-be-plated solar cell is substantially parallel to a surface of the wafer-mounting frame.

In a further variation, the spring-loaded pins act as electrodes to electrically couple front and back surfaces of the to-be-plated solar cell to the cathode.

In a variation on the embodiment, the wafer-mounting frames are parallel to each other, and a distance between the wafer-mounting frames is between 2 and 20 cm.

In a variation on the embodiment, the wafer-mounting frame further includes a plurality of through holes, thereby facilitating uniform metal deposition of both the front and back surfaces of the solar cell.

In a variation on the embodiment, a gap between two adjacent wafer-holding jigs is between 1 and 10 cm wide.

In a variation on the embodiment, the electroplating apparatus further includes an auxiliary anode situated between the pair of wafer-mounting frames.

In a further variation, the auxiliary anode is made of one or more materials selected from the following group: stainless steel, Ti, and Pt.

In a further variation, the auxiliary anode is made of similar metals that form the anodes situated around edges of the tank.

BRIEF DESCRIPTION OF THE FIGURES

In the figures, like reference numerals refer to the same figure elements.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

Overview

Embodiments of the present invention provide a high-throughput electroplating apparatus. More specifically, the electroplating apparatus includes novel wafer-holding jigs each having two arms. Each arm of the jig holds a plurality of solar cells submerged in a plating bath, allowing the solar cells to be plated on both sides simultaneously. Compared with conventional electroplating systems that use single-arm wafer-holding jigs, the system that uses the double-arm jigs can double its throughput.

Electroplating System for Solar Cell Fabrication

Figure 1:
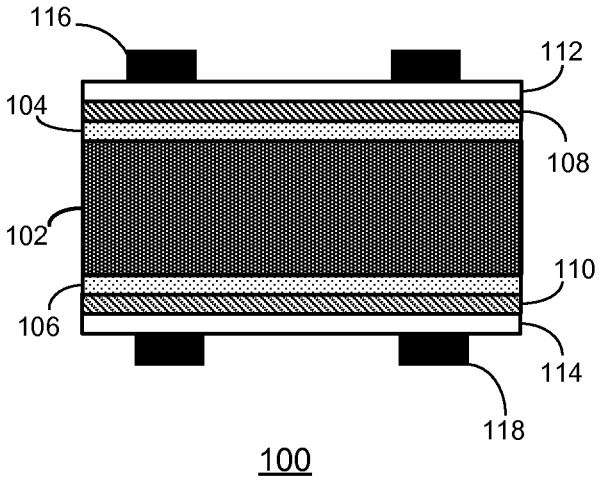
FIG. 1 presents a diagram illustrating an exemplary solar cell with electroplated metal grids, in accordance with an embodiment of the present invention.

It has been shown that, for solar cell applications, electroplated metal grids have lower resistivity compared with printed Ag grids, which include low-temperature-cured silver paste layers. For example, a metal grid that includes one or more electroplated Cu layers may have a resistivity equal to or less than $5\times10^{-6}$ Ω·cm, which is significantly lower than the resistivity of a metal grid that is composed of printed Ag. FIG. 1 presents a diagram illustrating an exemplary solar cell with electroplated metal grids, in accordance with an embodiment of the present invention. In the example shown in FIG. 1, solar cell 100 is a double-sided tunneling junction solar cell. More specifically, solar cell 100 includes a base layer 102, quantum tunneling barrier (QTB) layers 104 and 106 that cover both surfaces of base layer 102 and passivate the surface-defect states, a front-side doped a-Si layer forming a front emitter 108, a back-side doped a-Si layer forming a BSF layer 110, a front transparent conducting oxide (TCO) layer 112, a back TCO layer 114, a front-side electroplated metal grid 116, and a back-side electroplated metal grid 118. Note that a similar solar cell can have an emitter layer situated at the backside and a front surface field (FSF) layer situated at the front side. In addition to the tunneling junction solar cells, the electroplated metal grids can also be incorporated with other types of solar cell structure, such as diffusion based solar cells. Detailed descriptions of fabricating solar cells with electroplated metal grids can be found in U.S. patent application Ser. No. 12/835,670, entitled "SOLAR CELL WITH METAL GRID FABRICATED BY ELECTROPLATING," by inventors Jianming Fu, Zheng Xu, Chentao Yu, and Jiunn Benjamin Heng, filed 13 Jul. 2010, and U.S. patent application Ser. No. 13/220,532, entitled "SOLAR CELL WITH ELECTROPLATED METAL GRID," by inventors Jianming Fu, Zheng Xu, Chentao Yu, and Jiunn Benjamin Heng, filed 29 Aug. 2011, the disclosures of which are herein incorporated by reference in their entirety.

In common electroplating settings, work pieces (the parts to be plated) are electrically coupled to a cathode, and the metal to be plated (such as Cu and Ni) forms the anode. To facilitate the flow of current, all components, including the anode and the work pieces) are submerged in a suitable electrolyte solution, and a voltage is applied between the anode and the cathode. For a large-scale fabrication of the solar cells, the electrolyte solution along with the anode are usually placed in a large tank, forming an electrolyte bath, and work pieces (in this case solar cells) connecting to a moving cathode sequentially enter the bath from one end and get plated while they move from one end of the tank to the other. The moving speed is controlled based on the desired plating thickness. The plated solar cells are taken out of the bath once they reach the other end while new solar cells continuously enter the bath. To ensure plating uniformity, the electrolyte solution is circulated and filtered.

Figure 2A:
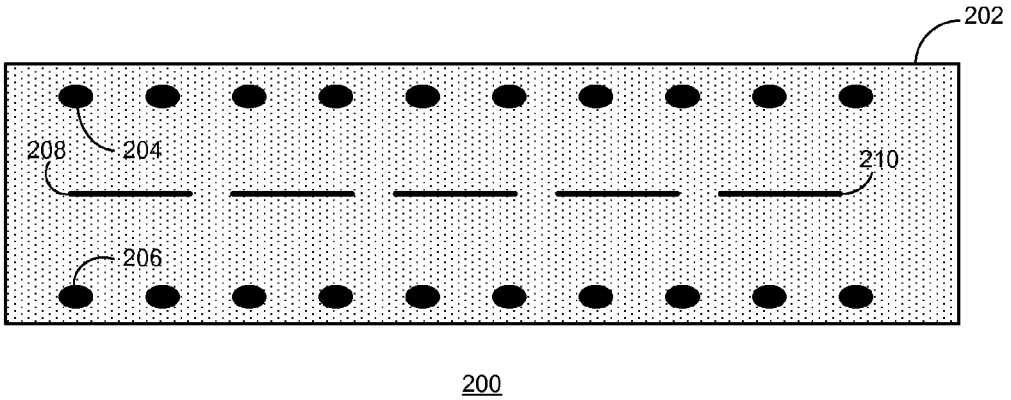
FIG. 2A (PRIOR ART)
FIG. 2A presents a diagram illustrating a schematic top view of a conventional electroplating system (prior art).
Figure 2B:
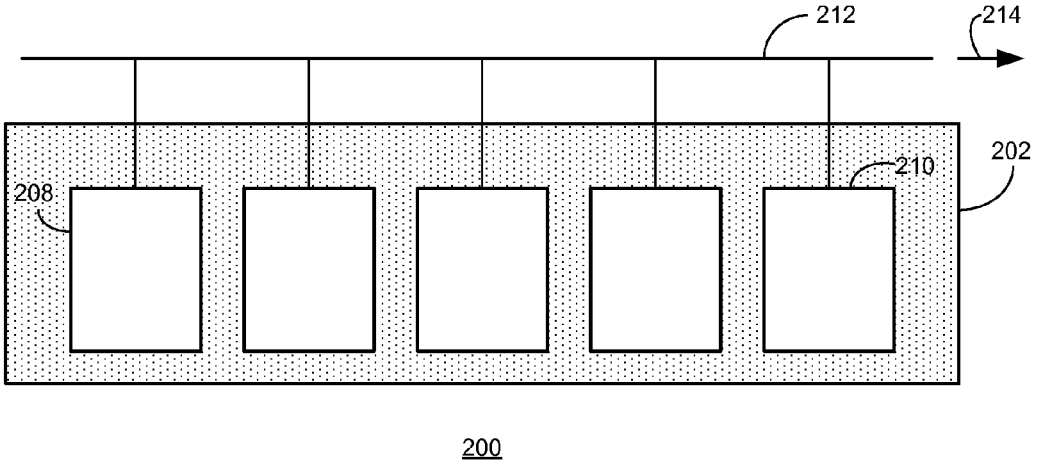
FIG. 2B (PRIOR ART)
FIG. 2B presents a diagram illustrating a schematic cross-sectional view of a conventional electroplating system (prior art).

FIG. 2A presents a diagram illustrating a schematic top view of a conventional electroplating system (prior art). In FIG. 2, an electroplating system 200 includes a rectangular tank 202 filled with electrolyte solution, a number of anodes (such as anodes 204 and 206) situated on both sides of tank 202, and a number of wafer-holding jigs, such as jigs 208 and 210, submerged in the electrolyte solution. Each jig can hold multiple wafers. Note that the wafer-holding jigs not only provide mounting places for the to-be-plated solar cells but also provide electrical connections between the plating surfaces (in this case, both side of the solar cells) and the cathode (not shown in FIG. 2B), thus enabling metal ions to be deposited onto the plating surfaces. In the system shown in FIGS. 2A and 2B, the jigs placed in the bath form a single line, with each jig providing two plating surfaces (the front surface and the back surface). With a careful design, both sides of the solar cells mounted on a jig can be electroplated simultaneously. For example, both the front and back surfaces of a solar cell can include conducting portions that are electrically connected to the cathode and are exposed to the electrolyte solution. Hence, these conducting portions of both surfaces will be plated simultaneously.

FIG. 2B presents a diagram illustrating a schematic cross-sectional view of a conventional electroplating system (prior art). More specifically, FIG. 2B shows that the wafer-holding jigs, such as jigs 208 and 210, are attached to a cathode 212 and are submerged in the electrolyte solution inside tank 202. During plating, cathode 212, and hence the jigs and solar cells mounted on the jigs, can move along the longer edger of tank 202, as indicated by arrow 214, and the both sides of the solar cells are plated during the process. Depending on the desired plating thickness, various parameters, such as the moving speed of the jigs and the voltage applied between the cathode and the anodes, can be adjusted.

Electroplating system 200 shown in FIGS. 2A and 2B allows continuous, simultaneous plating of a plurality of solar cells, and hence it is favored for high-throughput fabrication of solar cells. However, such a system often occupies a large space (due to the size of the tank, which can be up to 50 m long), and a large-scale solar cell manufacturing facility may need to accommodate many such systems. In addition, building and maintaining such systems can also be costly. Therefore, it is desirable to improve the throughput of each electroplating system in order to reduce the number of needed equipments and to save space and cost.

In some embodiments of the present invention, in order to improve the plating throughput each wafer-holding jig provides four, instead of two, plating surfaces, thus allowing simultaneous plating of twice as many solar cells. More specifically, each jig now has two arms, with each arm holding multiple solar cells.

Figure 3B:
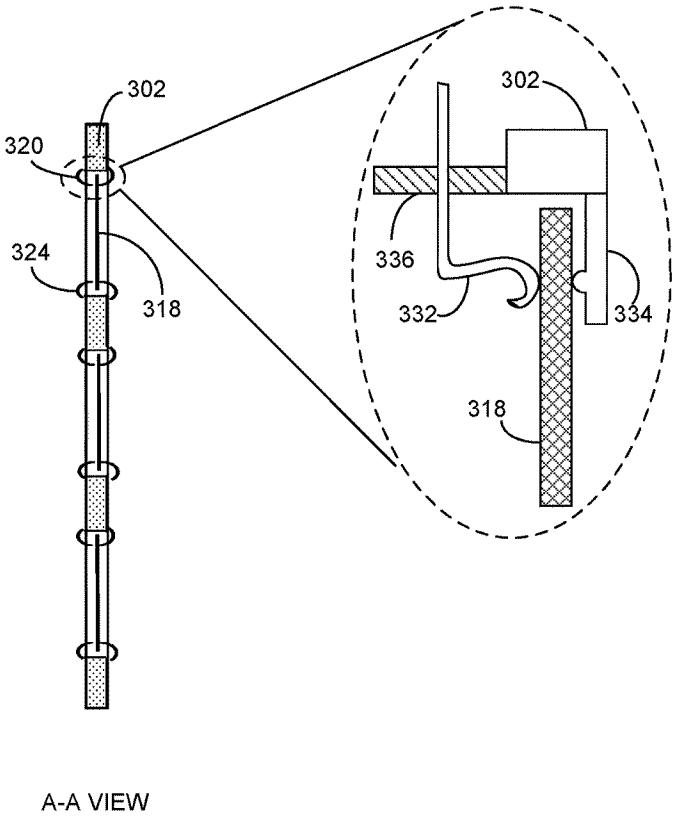
FIG. 3B presents a diagram illustrating a cross-sectional view of one arm of the wafer-holding jig, in accordance with an embodiment of the present invention.
Figure 3A:
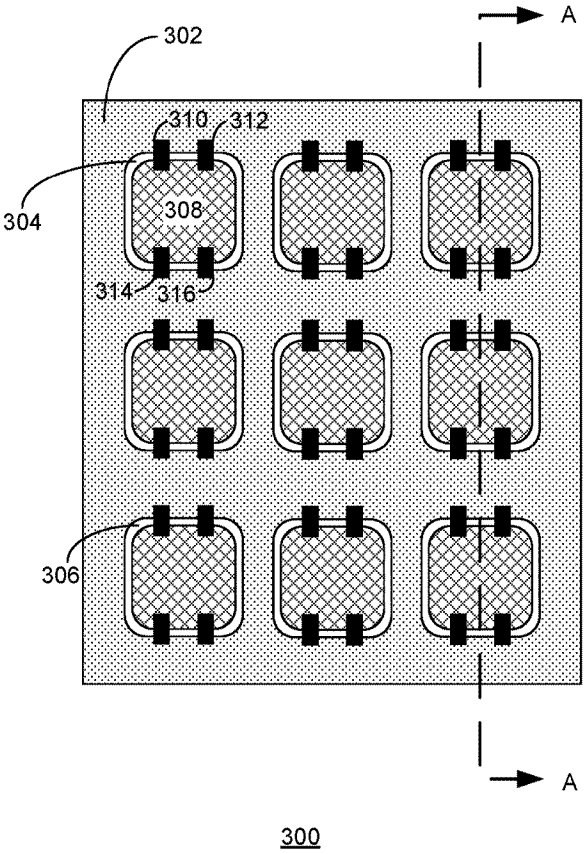
FIG. 3A presents a diagram illustrating a partial front view of one arm of the wafer-holding jig, in accordance with an embodiment of the present invention.

FIG. 3A presents a diagram illustrating a partial front view of one arm of the wafer-holding jig, in accordance with an embodiment of the present invention. In FIG. 3A, a wafer-holding jig 300 includes a frame 302, which include a number of pre-cut openings, such as openings 304 and 306. A to-be-plated solar cell can be placed inside an opening and mounted on frame 302 by multiple spring-loaded pins. For example, a solar cell 308 is placed inside opening 304 with its edges pined in position by spring-loaded pins 310, 312, 314, and 316. Note that, because the solar cells are mounted on frame 302 via the pre-cutting openings, both sides of the solar cells are exposed to the electrolyte solution and can be plated simultaneously.

Frame 302 is typically made of chemical-resistant metals, such as stainless steel, Cu, Ti, etc. In some embodiments, frame 302 is made of stainless steel. To prevent unintentional plating, most areas of frame 302 are covered with chemical-resistant paint and are electrically insulated, except at locations where electrical connections are needed. For example, at the location where frame 302 is in contact with a movable cathode (not shown in FIG. 3A), frame 302 may remain bare to enable direct electrical connection. In some embodiments, the cathode includes a metal rode that has a number of frame-hanging studs, and frame 302 can hang on one or more of the studs. Electrical connections between the frame and the cathode may be established via the direct metal-to-metal contact. The pre-cut openings may have difference sizes in order to fit solar cells of different sizes. In some embodiments, the solar cells have a dimension of 125×125 $mm^2$ (or 5×5 $inch^2$), and the openings can then have a dimension of 130×130 $mm^2$ or a slightly larger dimension. In addition, depending on the design and the size of the plating tank, frame 302 may accommodate different number of solar cells. In the example shown in FIG. 3A, frame 302 includes 9 (3 rows and 3 columns) pre-cut openings, capable of holding 9 solar cells. In some embodiments, a frame may include 15 (5 rows and 3 columns) or more pre-cut openings. In such a case, frame 302 may be as large as 450×800 $mm^2$.

FIG. 3B presents a diagram illustrating a cross-sectional view of one arm of the wafer-holding jig, in accordance with an embodiment of the present invention. From FIG. 3B, one can see that the solar cells, such as a solar cell 318, are held in place within the openings by the multiple spring-loaded pins. For example, FIG. 3B shows that solar cell 318 is held in place by at least spring-loaded pins 320 and 324. More specifically, the spring-loaded pins hold the solar cells in a way that surfaces of solar cells are substantially parallel to the surface of the frame, as shown in FIGS. 3A and 3B.

The spring-loaded pins situated around each opening not only provide support to the solar cells but also act as electrodes that enable electrical connections between the solar cells and the metal frame. In the amplified view of spring-loaded pin 320 shown in FIG. 3B, one can see that a spring-loaded pin includes a front part 332 and a back part 334, with front part 332 being rotatable (in and out of the paper) by loading and unloading spring 336 and back part 334 being fixed in position. Note that both front part 332 and back part 334 have an extruded point that together can apply pressure to solar cell 318, which is situated between them. Note that the amount of pressure being applied to solar cell 318 can be carefully adjusted to make sure that such pressure can hold solar cell 318 in position without damaging it. Moreover, in some embodiments, the extruded portions of front part 332 and back part 334 include bare metal (which can be stainless steel, Cu, or Ti), thus facilitating the electrical coupling between both surfaces of solar cell 318 and the cathode, which is electrically coupled to the spring-loaded pins via frame 302. In some embodiments, the surfaces of solar cell 318 include pre-patterned (as bus bars and finger grids) seed and/or adhesive metal layers, and the extruded portions of front part 332 and back part 334 of spring-loaded pin 320 are in direct contact with the bus bars.

Figure 4B:
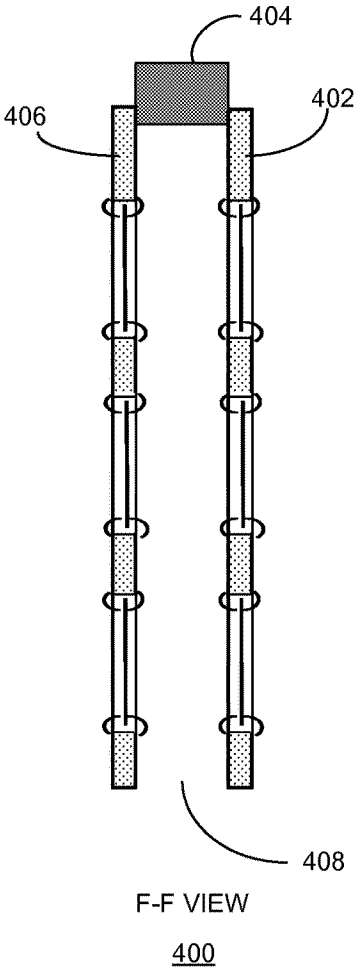
FIG. 4B presents a diagram illustrating a cross-sectional view of the double-arm wafer-holding jig, in accordance with an embodiment of the present invention.
Figure 4A:
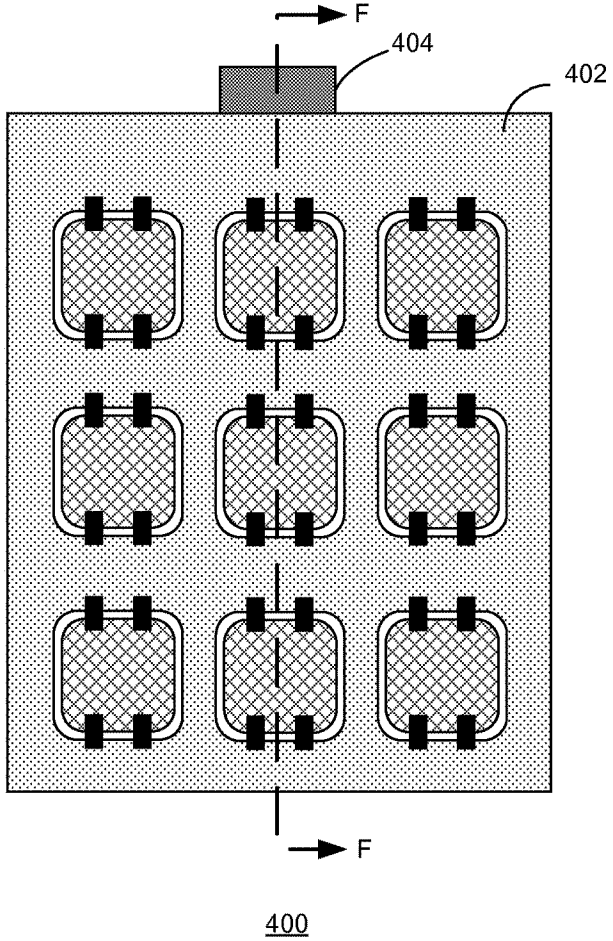
FIG. 4A presents a diagram illustrating a front view of a double-arm wafer-holding jig, in accordance with an embodiment of the present invention.

FIG. 4A presents a diagram illustrating a front view of a double-arm wafer-holding jig, in accordance with an embodiment of the present invention. In FIG. 4A, the front view of double-arm wafer-holding jig 400 shows a frame 402 and a common connector 404. Frame 402 is similar to frame 302 shown in FIG. 3A, and includes a number of pre-cut openings for mounting solar cells. Common connector 404 is a joint connection that connects both arms of double-arm wafer-holding jig 400 to the cathode (not shown in FIG. 4A). In some embodiments, common connector 404 may include a metal piece that is electrically coupled to the bare metal portion located on the metal frame of each arm.

FIG. 4B presents a diagram illustrating a cross-sectional view of the double-arm wafer-holding jig, in accordance with an embodiment of the present invention. FIG. 4B shows that double-arm wafer-holding jig 400 includes two parallel situated arms (frames 402 and 406) and a common connector 404. The two parallel arms are mechanically attached to and electrically connected to common connector 404. In some embodiment, common connector 404 may include a metal beam. Each arm or frame shown in FIG. 4B is similar to frame 302 shown in FIG. 3B, and is capable of holding multiple solar cells. From FIG. 4B, one can see that, given the frames being identical, double-arm wafer-holding jig 400 can accommodate twice as many solar cells as a wafer-holding jig that has only one arm. When double-arm wafer-holding jig 400 is placed in the electrolyte bath, a channel 408 is formed, and electrolyte solution can flow in and out of channel 408. Therefore, the solar cell surfaces that face channel 408 can be plated the same time when the solar cell surfaces that face away channel 408 are plated. To ensure the plating of a sufficiently thick metal layer and to ensure the plating uniformity, the width of channel 408 (determined by the distance between frames 402 and 406) needs to be sufficiently large. In some embodiments, such a distance is kept between 2 and 20 cm. Note that jigs with a larger distance ensure better uniformity, but would need a larger tank to accommodate them.

Figure 5:
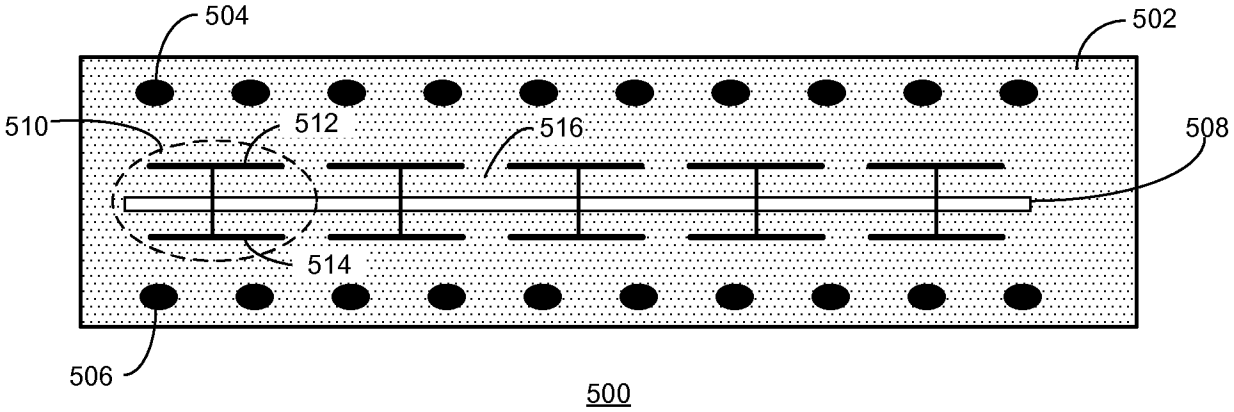
FIG. 5 presents a diagram illustrating a schematic top view of an electroplating system, in accordance with an embodiment of the present invention.

FIG. 5 presents a diagram illustrating the schematic top view of an electroplating system, in accordance with an embodiment of the present invention. In FIG. 5, an electroplating system 500 includes a rectangular tank 502 filled with electrolyte solution, a number of anodes (such as anodes 504 and 506) situated on both sides of tank 502, a cathode 508 situated above tank 502, and a number of double-arm wafer-holding jigs, such as a double-arm wafer-holding jig 510, attached to cathode 508. Rectangular tank 502 can be a standard tank built for large-scale electroplating operations. In some embodiments, the length of tank 502 can be between 4 and 50 m, and the width of tank 502 can be between 0.3 and 1 m. Depending on the size of tank 502, the number of wafer-holding jigs that are simultaneously submerged in tank 502 may vary. Note that, during operation, cathode 508 may move along the longer edge of tank 502, and jigs that are connected to cathode 508 then move together with cathode 508, moving from one end of tank 502 to the other end of tank 502. Each double-arm wafer-holding jig includes two parallel arms (or frames) for holding solar cells in an upright position in the electrolyte solution. For example, double-arm wafer-holding jig 510 includes a frame 512 and a frame 514 that are situated substantially parallel to each other. Note that each arm or frame can hold a plurality of solar cells with both sides of the solar cells exposed to the electrolyte solution to enable plating. More specifically, the anodes situated at both sides of tank 502, the electrolyte solution, and the conducting portions of solar cell surfaces (which are electrically coupled to cathode 508) form a closed circuit, and metal ions dissolved from the anodes are deposited onto the surfaces of the solar cells.

From FIG. 5, one can see that when solar cells are mounted on the double-arm wafer holding jigs, one side of the solar cells are facing the anodes, whereas the other side of the solar cells are facing the channel formed by the two arms of the jigs. This may lead to an uneven metal deposition on the two sides of the solar cells, because the electric field lines pointing to the channel-facing surface cells may be partially blocked by the metal frame itself, resulting in a weaker electrical field intensity at the channel-facing surface. Although the electrical field can still reach the channel-facing surface through the top and bottom opening of the channel, and through the gaps (such as a gap 516) between adjacent jigs, the field distribution at the channel-facing surface may be non-uniform and may not match the field intensity at the anode-facing surface. In addition, movement of metal ions may also be blocked by the frame, although may can go through the gaps by diffusion and circulation flow of the electrolyte solution. Installing carefully designed spargers at the tank edge may direct the electrolyte solution flow direction, assisting the flow of the metal ions. However, the different electric field strength between the anode-facing surface and the channel-facing surface can still lead to metal layers of different thickness being deposited at these two surfaces.

Increasing the gaps between two adjacent jigs may slightly improve the deposition uniformity between the two sides, because the increased gap allows stronger electrical field to go through to reach the channel-facing surface. However, the increased gap may reduce the overall throughput of plating system 500 due to the reduced number of jigs that can be accommodated in tank 502. In some embodiments, the distance between two adjacent double-arm wafer-holding jigs is between 1 and 10 cm. In a further embodiment, the distance is between 4 and 5 cm. Note that certain solar cells may require the front and back surfaces to have metal grids with different thicknesses. In such a scenario, the solar cells are place in a way such that the side requiring a thicker metal layer is facing the anodes. For example, some solar cells may require thicker metal grids on their front, light-facing surface and thinner metal grids on their back surface. To obtain this desired plating effect, one may mount the solar cells on each arm of the jig with the front surface facing the anodes, and the back surface facing the channel in between the arms. Note that the jigs may be placed in the tank in a symmetrical way to ensure that solar cells located on different arms are plated identically. For example, in some embodiments, the symmetrical axis of the jigs are aligned to the symmetrical axis of the electrolyte bath such that the electrical field is distributed symmetrically with the anode-facing surfaces of solar cells on both arms experiencing the same field intensity. Similarly, the channel-facing surfaces of solar cells on both arms also experience the same field intensity, resulting in similar plating effects on these surfaces.

Figure 6:
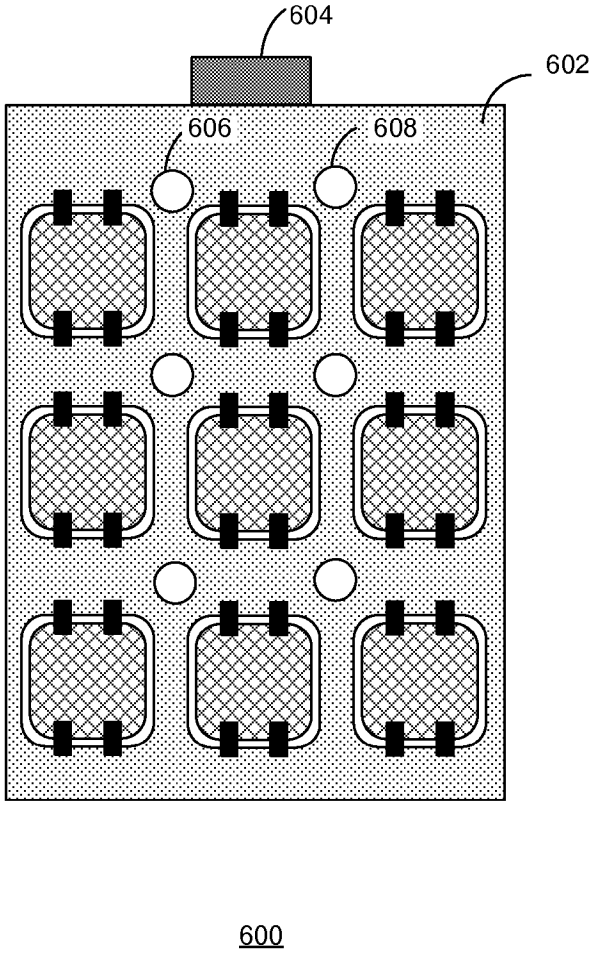
FIG. 6 presents a diagram illustrating a front view of a double-arm wafer-holding jig, in accordance with an embodiment of the present invention.

In addition to adjusting the width of the gaps between jigs, in some embodiments, extra holes may be introduced on the metal frames to allow the penetration of the electric field. FIG. 6 presents a diagram illustrating a front view of a double-arm wafer-holding jig, in accordance with an embodiment of the present invention. In FIG. 6, the front view of double-arm wafer-holding jig 600 shows a frame 602 and a common connector 604. In addition to the pre-cut openings for mounting the solar cells, frame 602 includes a number of through holes, such as through holes 606 and 608. These through holes not only allow metal ions to reach the other side of frame 602 along with the flow of the electrolyte solution, but also allow additional electrical field to reach the other side of frame 602. A careful design of the shapes and sizes of these through holes may further improve the plating uniformity, especially on the channel-facing surface of the solar cells.

Figure 7:
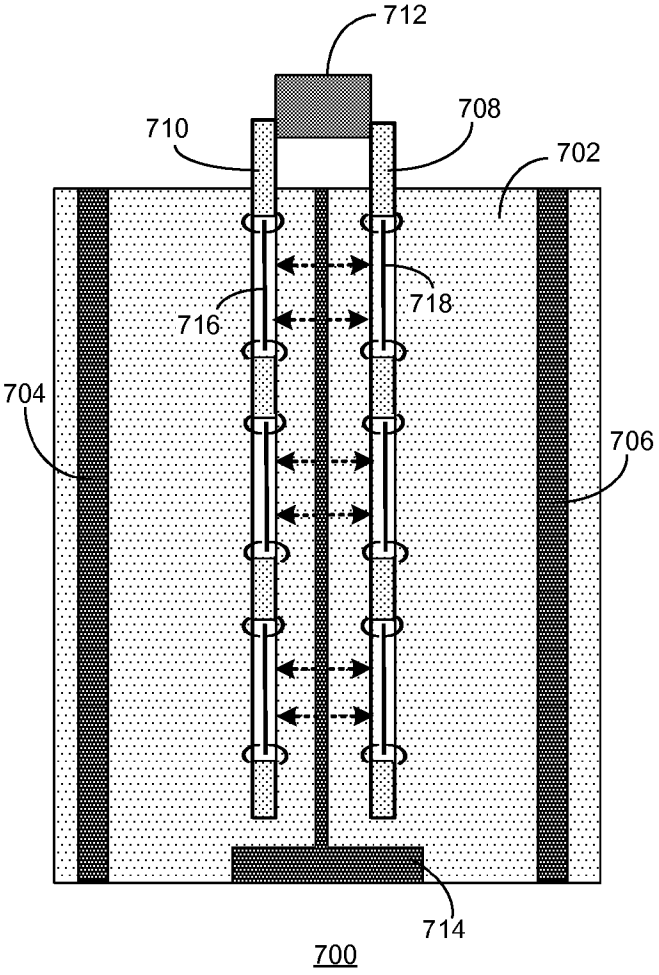
FIG. 7 presents a diagram illustrating a cross-sectional view of an electroplating system, in accordance with an embodiment of the present invention.

Another way for improving the deposition uniformity is to insert an auxiliary anode between the two arms of the double-arm wafer-holding jig in order to introduce additional electrical field. FIG. 7 presents a diagram illustrating a cross-sectional view of an electroplating system, in accordance with an embodiment of the present invention. In FIG. 7, electroplating system 700 includes a tank 702 filled with electrolyte solutions, a number of anodes (such as anodes 704 and 706, a double-arm wafer-holding jig that includes a pair of wafer-holding frames 708 and 710 and a common connector 712, and an auxiliary anode 714 situated between frames 708 and 710. In some embodiments, tank 702 can be a stainless steel tank; anodes 704 and 704 may be cylindrically shaped metal rods that are made of metals that are to be deposited on the solar cell surfaces, such as Cu and Ni. As described previously, common connector 712 is electrically coupled to the cathode (not shown in FIG. 7), and the to-be-plated surfaces of the solar cells, such as solar cells 716 and 718, are electrically coupled to common connector 712 via s number of spring-loaded pins. Therefore, the to-be-plated surfaces, including the surfaces facing away from anodes 704 and 706 are electrically coupled to the cathode.

During plating, a voltage is applied between the anodes (such as anodes 704 and 706) and the cathode, thus facilitating metal ions dissolved from the anodes to be deposited on the conducting portions of the solar cell surfaces. In the mean time, a voltage can be applied between auxiliary anode 714 and the cathode, creating additional electric field, as indicated by the dashed arrows. The additional electrical field can improve the uniformity of the metal deposition on the solar cell surface (often the back surface) that faces away from the anodes. Moreover, it can slightly increase the electrical field intensity at the channel-facing surface, making it possible to match the field intensity at the channel-facing surface to the field intensity at the anode-facing surface.

In some embodiments, auxiliary anode 714 includes noble metals, such as platinum (Pt), titanium (Ti), and stainless steel. In such scenarios, auxiliary anode 714 only provides additional electrical field within the channel formed by the two arms of the wafer-holding jig, but does not participate actively (providing metal ions) in the electroplating process. Note that the shape of auxiliary anode 714 and the amount of voltage applied can be carefully designed to further improve the deposition uniformity or to achieve the desired metal plating effect.

In some embodiments, auxiliary anode 714 may include the metal used for plating, and hence actively participates in the electroplating process. In other words, auxiliary anode 714 can have a similar material make up as that of anodes 704 and 706. For example, when Cu is plated on the solar cell surfaces, auxiliary anode 714 may include Cu to provide additional Cu deposition at the back surface of the solar cells, thus ensuring that the back surface of the solar cells can be plated with a Cu layer of the same thickness as the Cu layer plated on the front surface. However, such as an arrangement has a drawback because the active anode needs to be replaced or replenished on a regular basis, requiring extra maintenance.

In addition to the configurations shown in FIGS. 4-7, the electroplating system may have different configurations as long as the wafer-holding jigs are capable of providing multiple wafer-mounting surfaces that enables effective use of space. In the example shown in FIGS. 4B and 7, each wafer-holding jig includes two parallel arms, with each arm providing a wafer-mounting surface. In practice, it is also possible to have more than two arms or to have the arms configured in a different way as long as plating uniformity can be achieved. For example, a jig with 4 arms may be configured to have all arms parallel to each other or to have the arms grouped into two pairs with each pair comprising two parallel arms. However, the more complex the jigs are, the more difficult it is to achieve the desired deposition uniformity. To do so, a more sophisticated design of the auxiliary anode or the spargers may be needed. Also noted that, in addition to electroplating solar cells, embodiments of the present invention can also be used for electroplating of other types of device, such as printed circuit board (PCB). Moreover, in the examples shown in FIG. 4A and FIG. 6, the frames are rectangular. In practice, the frames may take on other shapes that are suitable to accommodate the devices being plated.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention.

What is claimed is:

1. A wafer-holding jig for electroplating of a plurality of photovoltaic structures, comprising:

a common connector electrically coupled to a cathode, wherein the common connector is a metal beam;

a wafer-holding mechanism consisting of a pair of wafer-mounting frames electrically coupled to the common connector, wherein each wafer-mounting frame comprises a plurality of openings and a plurality of spring-loaded mechanisms that hold to-be-plated photovoltaic structures in the openings, wherein each wafer-mounting frame comprises a plurality of through holes that are positioned between the openings, thereby facilitating flow of metal ions and electric field through the frame, wherein each spring-loaded mechanism comprises a back part in a fixed position, a rotatable front part, and a spring coupling the back part and the front part, wherein one end of the spring is directly attached to the wafer-mounting frame, wherein the wafer-mounting frames are arranged in such a way that a first to-be-plated photovoltaic structure mounted on a first wafer-mounting frame is positioned substantially parallel to a second to-be-plated photovoltaic structure mounted on a second wafer-mounting frame, wherein an open space exists between the first to-be-plated photovoltaic structure and the second to-be-plated photovoltaic structure to facilitate simultaneous plating of front and back surfaces of the plurality of the photovoltaic structures, and wherein a distance between the wafer-mounting frames is between 2 and 20 cm.

2. The wafer-holding jig of claim 1, wherein a respective wafer-mounting frame is made of one or more materials selected from the following group:

stainless steel;

Ti; and

Cu.

3. The wafer-holding jig of claim 1, wherein the opening is slightly larger than the to-be-plated solar cell.

4. The wafer-holding jig of claim 1, wherein the rotatable front part and the back part of the spring-loaded mechanism act as electrodes to electrically couple front and back surfaces of the to-be-plated photovoltaic structure to the cathode.

5. The wafer-holding jig of claim 1, wherein a respective wafer-mounting frame further includes a plurality of through holes, thereby facilitating uniform metal deposition of both the front and back surfaces of the plurality of photovoltaic structures.

6. An electroplating apparatus, comprising:

a tank filled with an electrolyte solution;

a number of anodes situated around edges of the tank;

a cathode; and a plurality of wafer-holding jigs attached to the cathode, wherein a respective wafer-holding jig comprises:

a common connector electrically coupled to the cathode, wherein the common connector is a metal beam;

a wafer-holding mechanism consisting of a pair of wafer-mounting frames electrically coupled to the common connector, wherein each wafer-mounting frame includes a plurality of openings and a plurality of spring-loaded mechanisms that hold to-be-plated photovoltaic structures in the opening, wherein each wafer-mounting frame comprises a plurality of through holes that are positioned between the openings, thereby facilitating flow of metal ions and electric field through the frame, wherein each spring-loaded mechanism comprises a back part in a fixed position, a rotatable front part, and a spring coupling the back part and the front part, wherein one end of the spring is directly attached to the wafer-mounting frame, wherein the wafer-mounting frames are arranged in such a way that a first to-be-plated photovoltaic structure mounted on a first wafer-mounting frame is positioned substantially parallel to a second to-be-plated photovoltaic structure mounted on a second wafer-mounting frame, wherein an open space exists between the first to-be-plated photovoltaic structure and the second to-be-plated photovoltaic structure to facilitate simultaneous plating of both the front and back sides of the first and second to-be-plated photovoltaic structures, and wherein a distance between the wafer-mounting frames is between 2 and 20 cm.

7. The electroplating apparatus of claim 6, wherein the cathode is configured to move from one end of the tank to the other end of the tank, thereby facilitating continuous operation of the electroplating apparatus.

8. The electroplating apparatus of claim 6, wherein a respective wafer-mounting frame is made of one or more materials selected from the following group:

stainless steel;

Ti; and

Cu.

9. The electroplating apparatus of claim 6, wherein a respective opening is slightly larger than a to-be-plated photovoltaic structure.

10. The electroplating apparatus of claim 6, wherein the rotatable front part and the back part of the spring-loaded mechanism act as electrodes to electrically couple front and back surfaces of the to-be-plated photovoltaic structure to the cathode.

11. The electroplating apparatus of claim 6, wherein a respective wafer-mounting frame further includes a plurality of through holes, thereby facilitating uniform metal deposition of both the front and back surfaces of to-be-plated photovoltaic structures.

12. The electroplating apparatus of claim 6, wherein a gap between two adjacent wafer-holding jigs is between 1 and 10 cm wide.

13. The electroplating apparatus of claim 6, further comprising an auxiliary anode situated between the pair of wafer-mounting frames.

14. The electroplating apparatus of claim 13, wherein the auxiliary anode is made of one or more materials selected from the following group:

stainless steel;

Ti; and

Pt.

15. The electroplating apparatus of claim 13, wherein the auxiliary anode is made of similar metals that form the anodes situated around edges of the tank.

* * * * *